US010060250B2

(12) United States Patent
Samson et al.

(10) Patent No.: US 10,060,250 B2
(45) Date of Patent: Aug. 28, 2018

(54) DOWNHOLE SYSTEMS AND METHODS FOR WATER SOURCE DETERMINATION

(75) Inventors: Etienne M. Samson, Cypress, TX (US); John L. Maida, Houston, TX (US); Rory D. Daussin, Spring, TX (US)

(73) Assignee: HALLIBURTON ENERGY SERVICES, INC., Duncan, OK (US)

( * ) Notice: Subject to any disclaimer, the term of this patent is extended or adjusted under 35 U.S.C. 154(b) by 1154 days.

(21) Appl. No.: 13/418,455

(22) Filed: Mar. 13, 2012

(65) Prior Publication Data

US 2013/0245947 A1 Sep. 19, 2013

(51) Int. Cl.
*G06F 19/00* (2018.01)
*E21B 47/10* (2012.01)

(52) U.S. Cl.
CPC ..... *E21B 47/10* (2013.01); *E21B 47/102* (2013.01); *E21B 47/1005* (2013.01)

(58) Field of Classification Search
CPC ..... G01N 31/32; G01N 33/18; G01N 21/00; E21B 47/10; E21B 47/102; E21B 47/1005
USPC ..... 436/85, 125; 702/6
See application file for complete search history.

(56) References Cited

U.S. PATENT DOCUMENTS

| | | | |
|---|---|---|---|
| 2,660,887 | A | 12/1953 | Frei |
| 2,852,693 | A | 9/1958 | Hughes et al. |
| 2,868,625 | A | 1/1959 | Frank et al. |
| 3,019,841 | A | 2/1962 | Ternow et al. |
| 3,282,095 | A | 11/1966 | Owens |
| 3,522,685 | A | 8/1970 | Oroschakoff |
| 3,722,271 | A | 3/1973 | Horvitz |
| 4,166,216 | A | 8/1979 | Cubberly |

(Continued)

FOREIGN PATENT DOCUMENTS

| | | |
|---|---|---|
| EP | 0 072 627 | 2/1983 |
| GB | 2368391 | 1/2002 |

(Continued)

OTHER PUBLICATIONS

Dessy, Waveguides as Chemical Sensors, Analytical Chemistry, vol. 61, No. 19, Oct. 1, 1989, pp. 1079A-1094A.*

(Continued)

*Primary Examiner* — Yoshihisa Ishizuka
(74) *Attorney, Agent, or Firm* — Gilliam IP PLLC

(57) ABSTRACT

A disclosed system for determining sources of water in a downhole fluid includes one or more downhole sensors that measure at least one analyte concentration in the downhole fluid, and a computer having analyte concentration characteristics for water from multiple sources. The computer uses the analyte concentration characteristics and the at least one analyte concentration measurement to determine an amount of water from at least one given source. A described method for determining sources of water in a downhole fluid includes associating with each of multiple sources of water a characteristic concentration of at least one analyte, obtaining measured concentrations of the at least one analyte with one or more downhole sensors, and deriving for at least one source of water a fraction of the downhole fluid attributable to that at least one source. The deriving may also be based upon measurements from distributed pressure and/or temperature sensors.

16 Claims, 3 Drawing Sheets

(56) References Cited

U.S. PATENT DOCUMENTS 4,407,365 A 10/1983 Cooke, Jr.
4,785,247 A 11/1988 Meador et al.
4,794,336 A 12/1988 Marlow et al.
4,802,761 A 2/1989 Bowen et al.
4,986,121 A 1/1991 Luscombe
5,037,172 A 8/1991 Hekman et al.
5,351,532 A 10/1994 Hager
5,429,190 A 7/1995 Kilgore et al.
5,626,192 A 5/1997 Connell et al.
5,712,828 A 1/1998 Luscombe et al.
5,729,013 A 3/1998 Bergren, III
5,892,860 A 4/1999 Maron et al.
5,943,293 A 8/1999 Luscombe et al.
6,053,245 A 4/2000 Haberman
6,128,251 A 10/2000 Erath et al.
6,160,762 A 12/2000 Luscombe et al.
6,188,645 B1 2/2001 Maida et al.
6,188,646 B1 2/2001 Luscombe et al.
6,195,162 B1 2/2001 Varnham et al.
6,211,964 B1 4/2001 Luscombe et al.
6,233,746 B1 5/2001 Skinner
6,256,588 B1 7/2001 Maida et al.
6,268,911 B1 7/2001 Tubel et al.
6,307,809 B1 10/2001 Luscombe et al.
6,408,943 B1 6/2002 Schultz et al.
6,422,084 B1 7/2002 Fernald et al.
6,522,797 B1 2/2003 Siems et al.
6,561,041 B1 5/2003 Eck
6,591,025 B1 7/2003 Siems et al.
6,627,873 B2 * 9/2003 Tchakarov et al. ..... 250/256
6,731,389 B2 5/2004 Luscombe et al.
6,789,621 B2 9/2004 Wetzel et al.
6,834,233 B2 12/2004 Economides et al.
6,847,034 B2 1/2005 Shah et al.
6,853,604 B2 2/2005 Spackman et al.
6,891,606 B2 5/2005 Smith et al.
6,907,170 B1 6/2005 Maida
6,913,083 B2 7/2005 Smith
6,931,188 B2 8/2005 Kersey et al.
6,939,717 B2 9/2005 Jiang et al.
6,957,574 B2 10/2005 Ogle
7,003,405 B1 * 2/2006 Ho ..... G01V 9/007 422/68.1
7,006,918 B2 2/2006 Economides et al.
7,028,773 B2 * 4/2006 Fujisawa et al. ..... 166/250.12
7,095,012 B2 8/2006 Fujisawa et al.
7,104,324 B2 9/2006 Wetzel et al.
7,159,468 B2 1/2007 Skinner et al.
7,163,055 B2 1/2007 Coon et al.
7,182,134 B2 2/2007 Wetzel et al.
7,216,710 B2 5/2007 Welton et al.
7,219,729 B2 5/2007 Bostick, III et al.
7,219,730 B2 5/2007 Tilton et al.
7,245,791 B2 7/2007 Rambow et al.
7,408,645 B2 8/2008 DiFoggio
7,409,858 B2 8/2008 Dria et al.
7,458,273 B2 12/2008 Skinner et al.
7,461,547 B2 12/2008 Terabayashi et al.
7,511,823 B2 * 3/2009 Schultz ..... G01D 5/35303 356/480
7,529,434 B2 5/2009 Taverner et al.
7,641,395 B2 1/2010 Ringgenberg et al.
7,665,543 B2 2/2010 Bostick, III et al.
7,669,440 B2 3/2010 Kersey et al.
7,733,490 B2 * 6/2010 Goodwin et al. ..... 356/436
7,864,321 B2 1/2011 Caron et al.
7,938,178 B2 5/2011 Ringgenberg et al.
8,104,338 B2 * 1/2012 DiFoggio ..... 73/152.55
8,230,916 B2 * 7/2012 Sumrall et al. ..... 166/250.01
8,447,529 B2 5/2013 Hernandez et al.
8,636,063 B2 1/2014 Ravi et al.
8,831,388 B2 9/2014 Boersma et al.
8,908,165 B2 * 12/2014 Tunheim et al. ..... 356/73
9,075,155 B2 7/2015 Luscombe et al.
9,297,767 B2 3/2016 Maida et al.
2003/0205375 A1 11/2003 Wright et al.
2003/0210403 A1 11/2003 Luscombe et al.
2005/0072678 A1 4/2005 Hunter et al.
2005/0169794 A1 8/2005 Welton et al.
2005/0207279 A1 9/2005 Chemali et al.
2005/0263281 A1 12/2005 Lovell et al.
2006/0010973 A1 * 1/2006 Brown ..... G01F 1/68 73/204.11
2006/0081412 A1 4/2006 Wright et al.
2007/0010404 A1 1/2007 Welton et al.
2007/0187648 A1 8/2007 Welton et al.
2007/0193351 A1 * 8/2007 DiFoggio ..... E21B 47/10 73/152.02
2008/0208476 A1 * 8/2008 Karami ..... E21B 43/00 702/6
2008/0227668 A1 9/2008 Welton et al.
2008/0227669 A1 9/2008 Welton
2008/0270789 A1 11/2008 Welton et al.
2008/0314139 A1 12/2008 DiFoggio
2009/0120640 A1 5/2009 Kulakofsky et al.
2009/0143258 A1 6/2009 Welton et al.
2009/0271115 A1 10/2009 Davis et al.
2010/0073001 A1 * 3/2010 Benischek ..... E21B 43/16 324/334
2010/0090660 A1 4/2010 Eger et al.
2010/0177310 A1 7/2010 DiFoggio
2010/0269579 A1 10/2010 Lawrence et al.
2011/0090496 A1 4/2011 Samson et al.
2011/0100629 A1 5/2011 Welton et al.
2011/0105386 A1 5/2011 Welton et al.
2011/0109912 A1 5/2011 Spross et al.
2011/0116099 A1 5/2011 Spross et al.
2011/0280103 A1 11/2011 Bostick, III et al.
2012/0257475 A1 10/2012 Luscombe et al.
2013/0031970 A1 * 2/2013 Freese et al. ..... 73/152.18
2013/0087328 A1 * 4/2013 Maida, Jr. ..... E21B 47/123 166/250.05
2013/0332130 A1 * 12/2013 Loveless et al. ..... 703/10

FOREIGN PATENT DOCUMENTS

GB 2401178 11/2004
GB 2 445 209 2/2008
WO WO-98/57030 12/1998
WO WO-01/81914 11/2001
WO WO-2006/063094 6/2006
WO WO-2008/081467 7/2008
WO WO-2009/007822 1/2009
WO WO-2010/090660 8/2010
WO WO-20110193401 2/2011
WO WO-2012/136951 10/2012
WO WO-2013/052891 A3 4/2013
WO WO-2013/137992 9/2013

OTHER PUBLICATIONS

"International Preliminary Report on Patentability", dated Jun. 23, 2014, Appl No. PCT/US2013/024845, "Downhole system and methods for water source determination," filed Feb. 6, 2013, 9 pgs.
"Non-final Office Action", dated Feb. 28, 2014, U.S. Appl. No. 2013/253,788, "Downhole Species Selective Optical Fiber Sensor Systems and Methods," filed Oct. 5, 2011, 19 pgs.
"PCT International Preliminary Report on Patentability", dated Sep. 26, 2013, Application No. PCT/US2012/059091, "Downhole Species Selective Optical Fiber Sensor Systems and Methods", filed Oct. 5, 2012, 27 pgs.
"PCT International Search Report and Written Opinion", dated Apr. 4, 2013, Appl No. PCT/US2012/059091, "Downhole Species Selective Optical Fiber Sensor Systems and Methods", filed Oct. 5, 2012, 27 pgs.
"Search report and written opinion", dated Jan. 16, 2014, Appl No. PCT/US2013/024845, "Downhole system and methods for water source determination," filed Feb. 6, 2013, 12 pgs.
"U.S. Application", dated Mar. 13, 2012, U.S. Appl. No. 13/418,455, "Downhole Systems and Methods for Water Source Determination", filed Mar. 13, 2012, 24 pgs.

(56) References Cited

OTHER PUBLICATIONS

"U.S. Final Office Action", dated Jun. 26, 2014, U.S. Appl. No. 2013/253,788, "Downhole Species Selective Optical Fiber Sensor Systems and Methods," filed Oct. 5, 2011, 12 pgs.
"U.S. Non-Final Office Action", dated Sep. 18, 2013, U.S. Appl. No. 13/253,788, "Downhole Species Selective Optical Fiber Sensor Systems and Methods", filed Oct. 5, 2011, 13 pgs.
Burns, D. W., et al., "Thin Films for Micromechanical Sensors", J. Vac. Sci. Technol. A 8(4), American Vacuum Society, (Jul. 1990), pp. 3606-3613.
Fan, Chunfang et al., "Scale Prediction and Inhibition for Unconventional Oil and Gas Production", SPE 130690, SPE International Conference on Oilfield Scale, Aberdeen, United Kingdom, May 26-27, 2010, pp. 1-22.
Halliburton Energy Services, Inc, "StimWatch Stimulation Monitoring Service—FiberWatch Fiber Optic Distributed Temperature Sensing Technology", Pinnacle, a Halliburton Services, http://www.halliburton.com/public/pe/contents/Data_Sheets/web/H/H04481.pdf, 2010, pp. 1-4.
Hirschfeld, Tomas et al., "Feasibility of using fiber optics for monitoring groundwater contaminants", Optical Engineering XP-002692941, vol. 22 No. 5, Sep.-Oct. 1983, pp. 527-531.
Kan, Amy T., et al., "Scale Prediction for Oil and Gas Production", SPE 132237, CPS/SPE International Oil & Gas Conference and Exhibition in China held in Beijing, China Jun. 8-10, 2010, 29 pgs.
Kohler, N. et al., "Static and Dynamic Evaluation of Calcium Carbonate Scale Formation and Inhibition", SPE 68963, SPE European Formation Damage Conference, The Hague, The Netherlands, May 21-22, 2001, pp. 1-11.
MacDougall, Trevor W., et al., "Large Diameter Waveguide Bragg Grating Components and Their Application in Downhole Oil & Gas Sensing", Weatherford International, Wallingford, CT, 12 pgs.
Martins-Filho, Joaquim F., et al., "Optical Fibre Sensor System for Multipoint Corrosion Detection", Optical Fiber New Developments, Christophe Lethien (Ed.), ISBN: 978-953-7619-50-3, InTech, DOI: 10.5772/7579, http://www.intechopen.com/books/optical-fiber-new-developments/optical-fibre-sensor-system-for-multipoint-corrosion-detection, Dec. 1, 2009, pp. 36-42.
Medhat, Abdou et al., "Finding value in formation water", Oilfield Review, vol. 23, No. 1, Mar. 1, 2011 (Mar. 1, 2011), pp. 24-35, XP055095547, ISSN: 0923-1730 p. 32-p. 35, 12 pgs.
Nancollas, G. H., et al., "The Kinetics of Crystallization of Scale-Forming Minerals", SPE 4360, Apr. 1974, 10 pgs.
Stiff, Henry A., et al., "A Method for Predicting the Tendency of Oil Field Waters to Deposit Calcium Carbonate", Petroleum Transactions, AIME, vol. 195, 1952, pp. 213-216.
Angelidis, Diogenes et al., "Optical Micromachined Pressure Sensor for Aerospace Applications", Optical Engineering, vol. 31, No. 8, (Aug. 1992), pp. 1636-1642.
Aratani, K. "Process and Design Considerations for Surface Micromachined Beams for a Tuneable Interferometer Array in Silicon", IEEE Xplore, IEEE, 1993., pp. 230-235.
Fan, Chunfang et al., "Scale Prediction and Inhibition for Unconventional Oil and Gas Production", SPE 130690, SPE International Conference on Oilfield Scale, Aberdeen, United Kingdom, May 26-27, 2010., pp. 1-22.
Halliburton Energy Services, Inc, "StimWatch Stimulation Monitoring Service—FiberWatch Fiber Optic Distributed Temperature Sensing Technology", Pinnacle, a Halliburton Services, http://www.halliburton.com/public/pe/contents/Data_Sheets/web/H/H04481.pdf, 2010, 4 pages., pp. 1-4.
Kris, R., et al., "Cement Slurry Monitoring", U.S. Appl No. 13/028,542, filed Feb. 15, 2011, 19 pgs.
Li, Weizhuo et al., "Wavelength Multiplexing of Microelectromechanical System Pressure and Temperature Sensors Using Fiber Bragg Gratings and Arrayed Waveguide Gratings", Opt. Eng. Society of Photo-Optical Instrumentation Engineers, 0091-3286/2003,, (Feb. 2003), pp. 431-438.
MacDougall, Trevor W., et al., "Large Diameter Waveguide Bragg Grating Components and Their Application in Downhole Oil & Gas Sensing", Weatherford International, Wallingford, CT, (Unknown),12 pgs.
Nancollas, G. H., et al., "The Kinetics of Crystallization of Scale-Forming Minerals", SPE 4360, Apr. 1974, 10 pages.
Putty, Michael W., et al., "Process Integration for Active Polysilicon Resonant Microstructures", Sensors and Actuators, 20, (1989),pp. 143-151.
Ravi, Kris et al., "Cement Slurry Monitoring", U.S. Appl. No. 13/028,542, filed Feb. 16, 2011, 19 pgs.
Tudor, M.J. et al., "Silicon Resonator Sensors: Interrogation Techniques and Characteristics", IEE Proceedings, vol. 135, Pt. D, No. 5, (Sep. 1988), pp. 364-368.
Unknown, "Optical Activation of a Silicon Vibrating Sensor", Electronic Letters, vol. 22, No. 21, (Oct. 9, 1986), pp. 1097-1099.
"AU Patent Examination Report No. 1", dated Apr. 1, 2015, Appl. No. 2012216882, "Cement Slurry Monitoring," filed Feb. 15, 2015, 3 Pgs.
"AU Patent Examination Report No. 1", dated Jun. 3, 2015, Appl No. 2013232590, "Downhole Systems and Methods for Water Source Determination," filed Feb. 6, 2013, 4 Pgs.
"CA Examiner's Letter", dated Mar. 11, 2015, Appl No. 2,830,141, "Optical Fiber Based Downhole Seismic Sensor Systems and Methods," filed Mar. 30, 2012, 4 Pgs.
"U.S. Non-Final Office Action", dated Jan. 30, 2015, U.S. Appl. No. 2013/253,788, "Downhole Species Selective Optical Fiber Sensor Systems and Methods," filed Oct. 5, 2011, 16 Pgs.
U.S. Final Office Action, dated Jul. 31, 2015, U.S. Appl. No. 2013/253,788, "Downhole Species Selective Optical Fiber Sensor Systems and Methods," filed Oct. 5, 2011, 14 pgs.
"CA Office Action", dated Jul. 12, 2016, Appl No. 2,859,347, "Downhole Systems and Methods for Water Source Determination", 4 pgs.
"EP Office Action", dated Dec. 2, 2016, Appl No. 12718307.7, "Optical Fiber Based Downhole Seismic Sensor Systems and Methods,".
"Canadian Application Serial No. 2,859,347, Office Action dated Jun. 1, 2017", 8 pages.

* cited by examiner

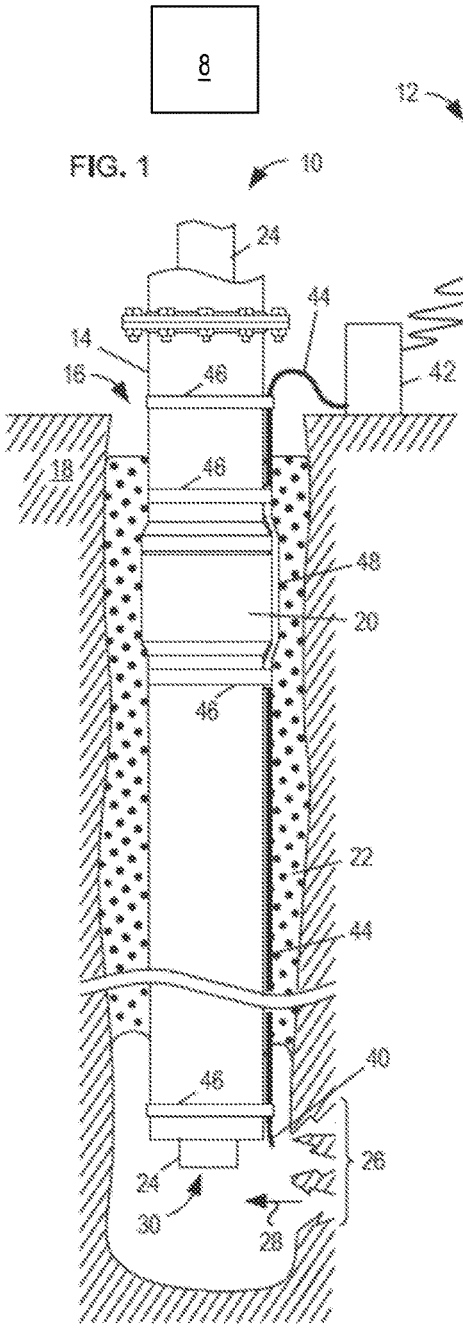
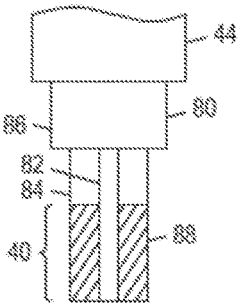
FIG. 2
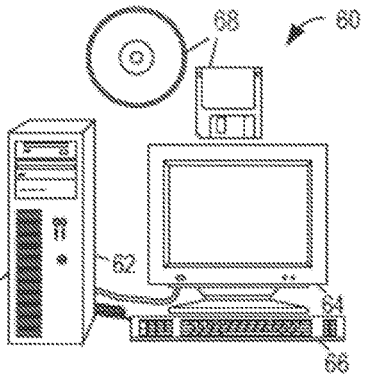
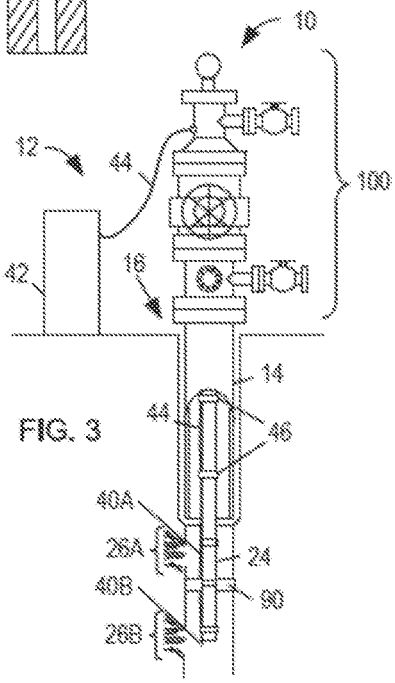
FIG. 3

DOWNHOLE SYSTEMS AND METHODS FOR WATER SOURCE DETERMINATION

BACKGROUND

After a wellbore has been drilled, the wellbore typically is cased by inserting lengths of steel pipe ("casing sections") connected end-to-end into the wellbore. Threaded exterior rings called couplings or collars are typically used to connect adjacent ends of the casing sections at casing joints. The result is a "casing string" including casing sections and connecting collars that extends from the surface to a bottom of the wellbore. The casing string is then cemented in place to complete the casing operation. After a wellbore is cased, the casing is often perforated to provide access to one or more desired formations, e.g., to enable fluid from the formation(s) to enter the wellbore.

Hydraulic fracturing is an operating technique where a fracturing fluid, typically water with selected additives, is pumped into a completed well under high pressure. The high pressure fracturing fluid causes fractures to form and propagate within the surrounding geological formation, making it easier for formation fluids to reach the wellbore. After the fracturing is complete, the pressure is reduced, allowing most of the fracturing fluid to flow back into the well. Some residual amount of the fracturing fluid may be expected to remain in the surrounding formation and perhaps flow back to the well over time as other fluids are produced from the formation. The volume and return rate of the fracturing fluid is indicative of the physical structure of the created fractures as well as the effective permeability for the newly-fractured completion zone.

During normal operations, the well produces a combination of fluids, typically including a desired hydrocarbon fluid (e.g., oil or gas) and water (i.e., "produced water"). The produced water can originate from multiple sources such as connate water from different formation layers, fracturing fluid, water injected from a remote well and/or steam injected from a remote well. These latter examples are typical of a steam or water flooding operation designed to force hydrocarbons to flow to the producing well.

In order to monitor and optimize hydraulic fracturing operations, and to better understand the relative permeabilities and physical structures of fractures resulting from hydraulic fracturing, it would be beneficial to determine the sources of water produced from each completion zone. For steam operations such as Steam-Assisted Gravity Drainage (SAGD) and water flooding operations, there is likewise a need to assess steam and water sweep areas. Despite these apparent benefits, there exists a need for improved systems or methods for such determinations.

BRIEF DESCRIPTION OF THE DRAWINGS

Accordingly, there are disclosed in the drawings and the following description specific examples of downhole systems and methods for water source determination. In the drawings:

FIG. 1 is a side elevation view of an illustrative downhole water source sensing system in a production well;

FIG. 2 is a diagram of an illustrative fiber optic cable and optical sensing system;

FIGS. 3-4 show alternative downhole water source sensing system embodiments;

Figure 4:
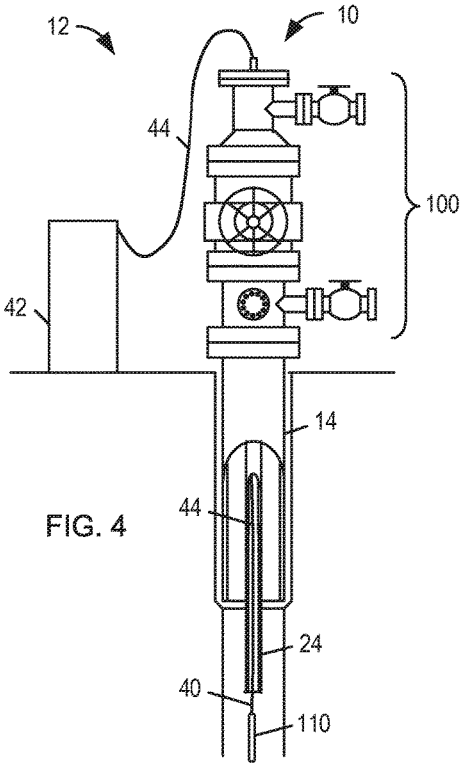

It should be understood, however, that the specific embodiments given in the drawings and detailed description thereof do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

Turning now to the figures, FIG. 1 shows a production well 10 equipped with an illustrative downhole water source sensing system 12. The well 10 shown in FIG. 1 has been constructed and completed in a typical manner, and it includes a casing string 14 positioned in a borehole 16 that has been formed in the earth 18 by a drill bit. The casing string 14 includes multiple tubular casing sections (usually about 30 foot long) connected end-to-end by couplings. One such coupling is shown in FIG. 1 and labeled '20.' Within the well 10, cement 22 has been injected between an outer surface of the casing string 14 and an inner surface of the borehole 16 and allowed to set. A production tubing string 24 has been positioned in an inner bore of the casing string 14.

The well 10 is adapted to guide a desired fluid (e.g., oil or gas) from a bottom of the borehole 16 to the surface of the earth 18. Perforations 26 have been formed at a bottom of the borehole 16 to facilitate the flow of a fluid 28 from a surrounding formation (i.e., a "formation fluid") into the borehole and thence to the surface via an opening 30 at the bottom of the production tubing string 24. Though only one perforated zone is shown, many production wells may have multiple such zones, e.g., to produce fluids from different formations.

The fluid 28 produced by the well includes the desired fluid (e.g., oil or gas) along with water (i.e., "produced water") originating from one or more sources. For example, the water in the produced fluid 28 may be a mixture of water from the surrounding formation (i.e., "formation water" such as connate water) and fracturing fluid previously pumped, by a pump 8, into the surrounding formation under high pressure via the production tubing string 24. Alternately, or in addition, the produced water may include water from other formations, or injected water from injection wells (e.g., flood fluid from a remote well). It is noted that the configuration of well 10 in FIG. 1 is illustrative and not limiting on the scope of the disclosure.

As described in more detail below, the downhole optical sensor system 12 is adapted to detect concentration(s) of one or more chemical species in the produced fluid 28. In some embodiments, the detected chemical species are known to be present in one or more sources of water contributing to the produced water in the fluid 28. In these embodiments, the downhole optical sensor system 12 makes it possible to determine a portion of the produced water originating from a given one of multiple potential sources of water. For example, the downhole optical sensor system 12 may be adapted to determine a portion of the produced water originating from fracturing fluid. This information can advantageously be used to monitor and optimize hydraulic fracturing operations, and to better understand the relative permeabilities and physical structures of fractures resulting from hydraulic fracturing.

In the embodiment of FIG. 1, the downhole optical sensor system 12 includes an optical sensor 40 in contact with the fluid 28 at the bottom of the borehole 16 and coupled to an interface 42 via a fiber optic cable 44. The interface 42 may be located on the surface of the earth 18 near the wellhead, i.e., a "surface interface". The optical sensor 40 includes a waveguide and is adapted to alter light passing through the waveguide dependent upon a concentration of one or more chemical species in the fluid 28.

In the embodiment of FIG. 1, the fiber optic cable 44 extends along an outer surface of the casing string 14 and is held against the outer surface of the of the casing string 14 at spaced apart locations by multiple bands 46 that extend around the casing string 14. A protective covering may be installed over the fiber optic cable 44 at each of the couplings of the casing string 14 to prevent the cable from being pinched or sheared by the coupling's contact with the borehole wall. In FIG. 1, a protective covering 48 is installed over the fiber optic cable 44 at the coupling 20 of the casing string 14 and is held in place by two of the bands 46 installed on either side of coupling 20.

In at least some embodiments, the fiber optic cable 44 terminates at surface interface 42 with an optical port adapted for coupling the fiber optic cable to a light source and a detector. The light source transmits light along the fiber optic cable to the optical sensor 40, which alters the light to provide some indication of a given chemical species concentration. The optical sensor 40 returns light along the fiber optic cable to the surface interface 42 where the optical port communicates it to the detector. The detector responsively produces an electrical output signal indicative of the concentration of the given chemical species in the produced fluid 28. The optical port may be configured to communicate the down-going light signal along one or more optical fibers that are different from the optical fibers carrying the return light signal, or may be configured to use the same optical fibers for communicating both light signals.

The illustrative downhole optical sensor system 12 of FIG. 1 further includes a computer 60 coupled to the surface interface 42 to control the light source and detector. The illustrated computer 60 includes a chassis 62, an output device 64 (e.g., a monitor as shown in FIG. 1, or a printer), an input device 66 (e.g., a keyboard), and information storage media 68 (e.g., magnetic or optical data storage disks). However, the computer may be implemented in different forms including, e.g., an embedded computer permanently installed as part of the surface interface 42, a portable computer that is plugged into the surface interface 42 as desired to collect data, a remote desktop computer coupled to the surface interface 42 via a wireless link and/or a wired computer network, a mobile phone/PDA, or indeed any electronic device having a programmable processor and an interface for I/O.

In some embodiments, the optical sensor 40 alters incoming light to provide an indication of a concentration of one or more selected chemical species (i.e., one or more selected analytes) known to be present in the produced water. As described above, the flow of fluid from the formation may include water from multiple sources. The computer 60 stores known concentration ranges of the one or more selected chemical species for each of the multiple possible sources of water (i.e., "analyte concentration characteristics"). The computer 60 receives the electrical output signal produced by the surface interface 42, uses the output signal to calculate a measured concentration of each of the selected analytes in the produced water, and uses the measured concentration of each of the selected analytes and the stored analyte concentration characteristics to determine a fraction of at least one source of water in the produced water. The computer 60 also uses a measured quantity of the produced fluid and the determined fraction of the at least one source of water to calculate an amount of water from the at least one source in the produced water.

For example, the produced water present in the fluid 28 may include a mixture of formation water and fracturing fluid. The optical sensor 40 may be configured to alter incoming light to provide an indication of a concentration of a selected analyte known to be present to a greater degree in the fracturing fluid, and to a lesser degree in the formation water. The computer 60 may store the analyte concentration characteristics for the fracturing fluid (i.e., the known concentration of the selected analyte in the fracturing fluid), and the analyte concentration characteristics for the formation water (i.e., the known concentration of the selected analyte in the formation water). The computer 60 may be adapted to receive the electrical output signal produced by the surface interface 42, to use the output signal to calculate a measured concentration of the selected analyte in the produced water, and to use the measured concentration of the selected analyte and the stored analyte concentration characteristics to determine a fraction of the fracturing fluid in the produced water. The computer 60 may also adapted to use a measured quantity of the produced fluid and the determined fraction of the fracturing fluid in the produced water to calculate an amount of the fracturing fluid produced.

In some embodiments, the information storage media 68 stores a software program for execution by computer 60. The instructions of the software program may cause the computer 60 to collect information regarding downhole conditions including selected analyte concentration(s) derived from the electrical signal from surface interface 42 and, based at least in part thereon, to determine an amount of produced water originating from at least one source. In addition to deriving the fraction of produced water from a given source, the computer may acquire a flow volume or a flow rate measurement that, when combined with the derived fraction, provides the flow volume or flow rate of produced water from the given source. To that end, the computer may be coupled to a downhole or surface fluid flow sensor to monitor, as a function of time, the flow rate and/or cumulative flow volume of produced fluids from the well. In some systems, fluid phase separators may be employed to separate gas, oil, and water components of the produced fluid, with separate flow sensor measurements being made for each phase.

As part of deriving the fraction or amount of produced water from a given source, the computer 60 may, for example, interpolate within the stored analyte concentration characteristics for multiple potential sources. The instructions of the software program may also cause the computer 60 to communicate to a user the amount (e.g., the relative fraction, the flow rate, or the accumulated flow volume) of produced water originating from at least one source. Note that the amount of produced water originating from the at least one source can be communicated via a graphical output device, via email or SMS text, via an audible or visual alarm indicator, or indeed by any suitable output technique.

In some embodiments, the amount of produced water originating from at least one source is determined as a difference or ratio between water amounts from different sources. The computer 60 may determine and display the amount of produced water originating from each of multiple sources as a function of time. The computer 60 may also determine and display the amount of produced water originating from each of multiple sources as a function of position in the borehole.

The software program executed by the computer 60 may, for example, embody a model for determining a fraction or amount of at least one source of water in produced water. Several suitable models are known in the oil and gas production industry. See, for example, "Returns Matching Reveals New Tools for Fracture/Reservoir Evaluation" by R. D. Gdanski et. al., Society of Petroleum Engineers (SPE) Paper No. 133806, Tight Gas Completions Conference, 2-3 Nov. 2010, San Antonio, Tex., USA, included herein by reference in its entirety. The model employed by the software program may, for example, use the measurements of the concentrations of one or more selected analytes in the produced fluid 28, along with measurements of temperatures and/or pressures of the produced fluid 28 along its flow path, to predict a fraction or amount of at least one source of water in the produced water.

In some embodiments, the software program executed by the computer 60 embodies the following equation model (from the above cited SPE Paper No. 133806) for determining a fraction of fracturing fluid ($F_{frac}$) in a produced fluid consisting substantially of a mixture of formation water and fracturing fluid:

$$F_{frac} = \frac{(C_{meas} - C_{form})}{(C_{frac} - C_{form})} \tag{1}$$

where $C_{meas}$ is the measured concentration of a selected analyte in the produced water, $C_{form}$ is the concentration of the selected analyte in the formation water (i.e., the analyte concentration characteristic for the formation water), and $C_{frac}$ is the concentration of the selected analyte in the fracturing fluid (i.e., the analyte concentration characteristic for the fracturing fluid). It is noted that the fraction of the fracturing fluid ($F_{frac}$) in the produced water ranges from 0.0 when the measured concentration of the selected analyte in the produced water ($C_{meas}$) is equal to the concentration of the selected analyte in the formation water ($C_{form}$), to 1.0 when the measured concentration of the selected analyte in the produced water ($C_{meas}$) is equal to the concentration of the selected analyte in the fracturing fluid ($C_{frac}$). As the difference between the concentrations of the selected analyte in the fracturing fluid ($C_{frac}$) and the formation water ($C_{form}$) is in the denominator, it is desirable that the difference between the concentrations of the selected analytes in the fracturing fluid (C 1 and the formation water ($C_{form}$) be as large as frac, possible. In an ideal situation, the concentration of the selected analyte in the fracturing fluid is relatively large, and the selected analyte is absent in the produced fluid ($C_{form}$=0).

Potentially suitable analytes include chemical species such as ions containing sodium, potassium, boron, calcium, magnesium, iron, barium, strontium, chloride, sulfur, and/or carbon. Examples of potentially suitable ionic analytes include containing sodium, potassium, boron, calcium, magnesium, iron, barium, strontium, chloride, sulfate, and bicarbonate. In some embodiments, multiple analyte concentrations are measured. The fraction of equation (1) may be calculated individually for each selected analyte, and the results combined with a weighted average to obtain an overall result.

It is possible to extend the above equation model to determine the fractions of produced water from each of multiple possible sources by solving a system of simultaneous equations where there is one equation for each possible source:

$$\begin{bmatrix} C_{11} & C_{12} & C_{1S} \\ C_{21} & C_{22} & C_{2S} \\ & & \\ C_{T1} & C_{T2} & C_{TS} \end{bmatrix} \begin{bmatrix} F_1 \\ F_2 \\ \\ F_S \end{bmatrix} = \begin{bmatrix} M_1 \\ M_2 \\ \\ M_T \end{bmatrix} \tag{2}$$

where the number of selected analytes is T, the number of potential water sources is S, $C_{IJ}$ is the concentration of the Jth selected analyte ($T \geq J \geq 1$) in the water from the Ith source ($S \geq I \geq 1$), $F_I$ is the fraction of the water from the Ith source in the produced water ($1.0 \geq F_I \geq 0.0$), and $M_J$ is the measured concentration of the Jth selected analytes in the produced water. This set of equations can be extended to include a fraction of produced fluid represented by non-water (e.g., hydrocarbon) sources by adding the appropriate terms for the analyte characteristics of such sources.

The software program executed by the computer 60 may alternatively embody a neural network or a support vector machine that has been programmed to estimate fractions $F_I$ when provided with measured analyte concentrations $M_J$. The term neural network has evolved to describe a new paradigm for computing based on the highly parallel architecture of neurons in animal brains. Neural networks are particularly useful for processing data from complex processes where an algorithm is not known, or has a relatively large number of variables. A neural network is an adaptive system that responds to inputs by producing outputs, and (at least in the training phase) changes its structure based on information flowing through the network. Neural networks learn input/output relationships through training. In supervised learning, a neural network user assembles a set of training data that contains examples of inputs together with the corresponding correct or desired outputs. During training, the training data is used to adjust weights and/or thresholds within the network so as to minimize an error between the outputs generated by the network and the correct or desired outputs of the training set. A properly trained neural network "models" the relationship or function between the inputs and the outputs, and can subsequently be used to generate outputs for inputs where the corresponding outputs are not known.

FIG. 2 is an enlarged diagram of an illustrative tip of fiber optic cable 44 with an optical sensor 40. In the embodiment of FIG. 2, fiber optic cable 44 includes at least one optical fiber 80 that can be exposed by pulling back the cable sheath. The optical fiber 80 includes a substantially transparent inner core 82 surrounded by a substantially transparent cladding layer 84 having a higher index of refraction, which causes the inner core 82 to serve as a waveguide. The cladding layer 84 is in turn surrounded by one or more protective layers 86 that prevents external gases from degrading the performance of the optical fiber.

The optical fiber 80 is provided with a sensing region 88 that, at least in some embodiments, is an exposed portion of the cladding layer 84 that may be further enhanced with a reagent designed to complex with a given chemical species in solution. The reagent region 88 of the optical sensor 40 surrounds the inner core 82 (i.e., the waveguide) and is in direct contact with both the waveguide and the produced fluid 28 (see FIG. 1). The reagent region 88 may include, for example, a reagent changes color (i.e., changes its light absorption spectrum) when it complexes with a chemical species in solution. The reagent may be or include, for example, a chromoionophore that complexes with ions of a selected chemical species such as, for example, sodium, potassium, boron/borates, calcium, magnesium, iron, barium, strontium, chloride, sulfates, and/or bicarbonates. The reagent may be suspended in or chemical bound to a medium that confines the reagent to the reagent region 88, yet enables the given chemical species to diffuse to or from the surrounding fluid in accordance with the concentration in that fluid. (See, for example, U.S. Pat. No. 7,864,321.)

Within the optical sensor 40, a portion of the light passing through the inner core 82 (i.e., the waveguide) of the optical sensor 40 expectedly interacts with the reagent region 88. When the reagent complexes with a chemical species in the produced fluid 28, the complexes may more strongly or more weakly absorb the particular wavelength of light traveling through the reagent region 88. As a result, the intensity of the light exiting the optical sensor 40 may be reduced dependent upon the concentration of the chemical species in the produced fluid 28. Again, the chemical species may be selected based on its known presence in water from at least one source contributing to the produced water.

In at least some embodiments of the downhole optical sensor system 12, the light source in the surface interface 42 provides pulses of light via the optical port to the optical fiber 80 of the fiber optic cable 44. The light has, or includes, one or more wavelengths that are absorbed in the reagent region 88 of the optical sensor 40 when the reagent complexes with a selected analyte in the produced fluid 28. The light may be or include, for example, near infrared light. When a light pulse reaches the optical sensor 40, the light passes through the optical sensor 40 and is altered (e.g., attenuated) within the reagent region 88 by an amount dependent on the concentration of the selected analyte in the produced fluid 28.

The light traveling through the optical sensor 40 may be routed back to the surface along a different optical fiber in cable 44. In the illustrated embodiment, however, the light traveling through the optical sensor 40 reaches an end of the inner core 82, which is polished or mirrored to reflect a substantial portion of the light incident on it. The reflected light travels back through the optical sensor 40 on its way to the surface interface 42. During the return trip through the optical sensor, the light pulse is further altered (e.g., attenuated) within the reagent region 88 dependent upon the concentration of the selected chemical species in the produced fluid 28. The reflected pulse of light then travels back through the optical fiber 80 of the fiber optic cable 44 to the surface interface 42. A light detector in the surface interface 42 receives the reflected pulse of light and produces the electrical output signal indicative of the concentration of the selected chemical species in the produced fluid 28. For example, the detected intensity of the received light pulse at a given frequency may be proportional to the concentration of the given species. Alternatively, the detected intensity may be a nonlinear function of the transmitted light intensity and the concentration of the given species, but the surface interface or the computer is provided with sufficient information to derive the desired concentration measurement.

It is noted that multiple optical sensors can be co-located to sense multiple analytes to better characterize the produced fluid 28. Optical sensors can also be deployed in multiple zones to sense fluids from different formations. FIG. 3 shows an alternative embodiment of downhole optical sensor system 12 where the fiber optic cable 44 is strapped to the outside of the production tubing 24 rather than the outside of casing 14. Two perforations 26A and 26B have been created in the borehole 16 to facilitate the obtaining of formation fluids from two different zones. Formation fluid from a first of the two zones enters the casing string 24 via the perforation 26A, and formation fluid from the other zone enters the production tubing string 24 via the perforation 26B. A packer 90 seals an annulus around the production tubing string 24 to define the two different zones. A first optical sensor 40A is positioned on one side of the packer 90 adjacent the perforation 26A, and a second optical sensor 40B is positioned on an opposite side of the packer 90 adjacent the perforation 26B. The sensor 40A allows measurements to be made in the formation fluid from the first zone, and the sensor 40B allows measurements to be made in the formation fluid from the other zone.

In the embodiment of FIG. 3, the optical sensors 40A and 40B are both coupled to the surface interface 42 via the fiber optic cable 44. The fiber optic cable 44 exits through an appropriate port in a "Christmas tree" 100, i.e., an assembly of valves, spools, and fittings connected to a top of a well to direct and control a flow of fluids to and from the well. The fiber optic cable 44 extends along the outer surface of the production tubing string 24, and is held against the outer surface of the of the production tubing string 24 at spaced apart locations by multiple bands 46 that extend around the production tubing string 24. In other embodiments, the optical sensors 40A and 40B may be coupled to the surface interface 42 via different fiber optic cables.

FIG. 4 shows another alternative embodiment of downhole optical sensor system 12 having the fiber optic cable 44 suspended inside production tubing 24. A weight 110 or other conveyance mechanism is employed to deploy and possibly anchor the fiber optic cable 44 within the production tubing 24 to minimize risks of tangling and movement of the cable from its desired location. The optical sensor 40 may be positioned at the bottom of the well near weight 110. The fiber optic cable 44 exits the well via an appropriate port in Christmas tree 100 and attaches to the surface interface 42.

Other alternative embodiments employ composite tubing with one or more optical fibers embedded in the wall of the tubing. The composite tubing can be employed as the casing and/or the production string. In either case, a coupling or terminator can be provided at the end of the composite tubing to couple an optical sensor 40 to the embedded optical fiber. In still other embodiments, the light source and/or light detector may be positioned downhole and coupled to the surface interface 42 via electrical conductors.

The well 10 illustrated in FIGS. 1 and 3-4 offers two potential flow paths for fluid to move between the surface and the bottom of the well. The first, and most commonly employed, is the interior of the production tubing. The second is the annular space between the production tubing and the casing. Usually the outermost annular space (outside the casing) is sealed by cement for a variety of reasons typically including the prevention of any fluid flow in this space. Usually, the point at which it is most desirable to measure concentrations of chemical species will be the point at which produced fluid enters the borehole, i.e., the completion zone, or points of potential constriction, e.g., where the fluid enters the flow path and any branches, chokes, or valves along the flow path. In some cases, one optical sensor 40 will be sufficient, and it can be located at the end of the fiber optic cable 44 in one of the deployments described previously.

However, other well configurations are known that have a substantial number of flow paths, particularly wells designed to produce from multiple completion zones. It may be desirable to provide multiple optical sensors 40 so as to be able to individually monitor each fluid flow. Moreover, it may be desirable to provide multiple optical sensors along a given fluid flow path, as such a well configuration may create atypical pressure and temperature changes along the flow path and, in some cases, mixing with other fluid flows. While it is possible to provide such sensors by providing a separate fiber optic cable for each optical sensor, it will be in many cases more efficient to provide a single fiber optic cable with multiple sensors.

Figure 5A:
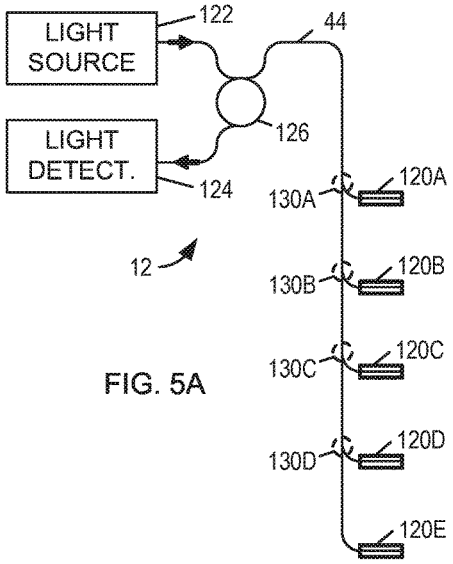
FIGS. 5A-5C show illustrative distributed downhole species sensing techniques.
Figure 5B:
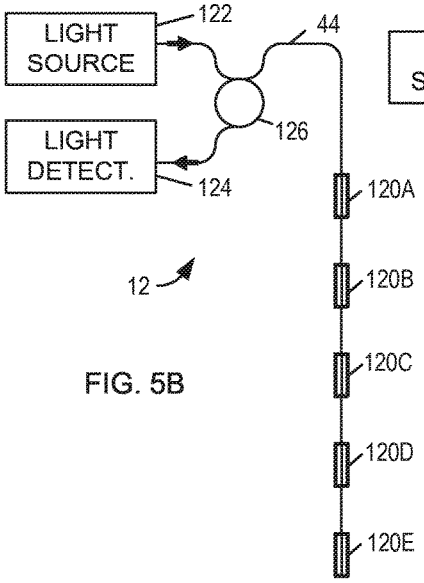
Figure 5C:
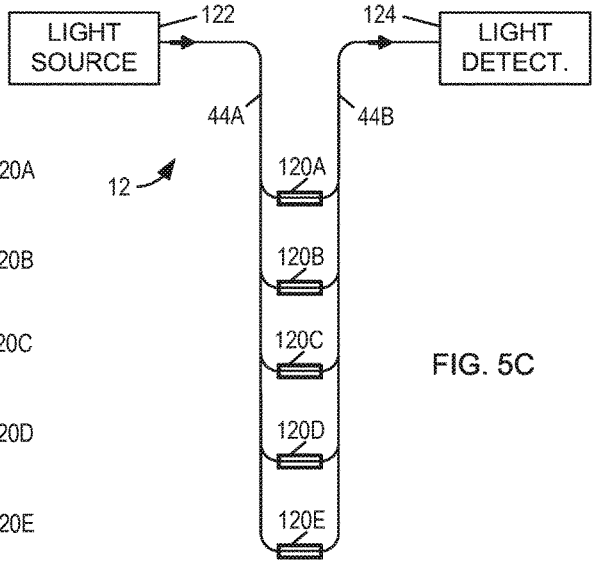

FIGS. 5A-5C show various illustrative downhole optical sensor system 12 embodiments that provide multiple sensors for a given fiber optic cable. FIGS. 5A-5C show multiple spaced-apart optical sensors 120A-120E, referred to collectively as the optical sensors 120. Placed in contact with a produced fluid each of the optical sensors 120 may be adapted to alter light passing therethrough dependent upon a concentration of one or more chemical species in the produced fluid (e.g., in a fashion similar to the optical sensor 40 of FIG. 2). Other ones of the optical sensors 120 may be adapted to alter light passing therethrough dependent upon a concentration of hydrogen ions in the produced fluid to indicate a pH of the produced fluid. Still other ones of the optical sensors 120 may be adapted to alter light passing therethrough dependent upon a temperature or a pressure of the produced fluid.

In the embodiment of FIG. 5A, the surface interface 42 for the downhole optical sensor system 12 includes a light source 122, a light detector 124, and an optical circulator 126 that couples the source and detector to fiber optic cable 44. Optical splitters 130A-130D couple the optical fiber to corresponding optical sensors 120A-120D, and a last optical sensor 120E may be coupled to the terminal end of the optical fiber. The optical circulator 126 routes pulses of light from light source 122 to the optical fiber in fiber optic cable 44. Each pulse of light propagates along the optical fiber to the series of optical splitters 130A-130D. Each splitter directs a portion of the light (e.g., 2%) to the corresponding sensor and passes the remainder of the light along the cable 44. Each optical sensor 120A-120E alters (e.g., attenuates) the light in accordance with the concentration of the selected chemical species and reflects back the altered light. The optical splitters 130A-130D recombine the reflected light into a single beam propagating upward along the fiber optic cable 44. Due to the travel-time differences, the light propagating upward now consists of a series of pulses, the first pulse corresponding to the first sensor 120A, the second pulse corresponding to the second sensor 120B, etc. The optical circulator 126 directs these pulses to the light detector 124 which determines a sensor measurement for each pulse.

Where the fiber optic cable 44 includes multiple optical fibers or multi-stranded optical fibers, the optical sensors 120A-120E can be directly coupled to different ones of the optical fibers or strands. The optical splitters would not be needed in this variation. The detector 124 can be coupled to measure the total light returned along the multiple fibers or strands, as the travel time difference to the various sensors will convert the transmitted light pulse into a series of reflected light pulses, with each pulse representing a corresponding optical sensor measurement.

In the embodiment of FIG. 5B, the downhole optical sensor system 12 also includes the light source 122, the light detector 124, and the optical circulator 126 as before. The optical sensors 120 are positioned in series along the fiber optic cable 44. Each of the optical sensors 120 is adapted to alter (e.g., attenuate) light in a distinct range of wavelengths (i.e., band of frequencies) such that the optical sensors 120 alter light in different wavelength ranges (i.e., frequency bands) while leaving the other wavelengths largely unaffected.

The light source 122 may produce light having components in each of the wavelength ranges corresponding to the optical sensors 120. As the light propagates along the fiber optic cable and through the optical sensors 120, each of the optical sensors alter the light components within their associated wavelength range. In the illustrated embodiment, the light reflects from the end of the cable and propagates back to the surface, passing a second time through each of the sensors which further alter (e.g., attenuate) the light component in their associated wavelength range. When the reflected light reaches the surface interface, the optical circulator 126 directs the reflected light to the light detector 124, which analyzes each of the wavelength ranges associated with the various sensors 120 to determine a measurement for each sensor.

The embodiment shown in FIG. 5C is similar to the embodiment of FIG. 5A. Rather than using a single optical fiber for both downward-going and upward-going light, however, the embodiment of FIG. 5C separates the downward-going light path 44A from the upward-going light path 44B. Though both paths may be contained in a single fiber optic cable, the two light paths are carried on separate fibers. Light pulses from source 122 travel downward on path 44A, are distributed to the optical sensors 120 as provided previously, and reach the detector 124 via path 44B. Travel time differences will produce a series of light pulses at the detector, each pulse corresponding to a different optical sensor. Alternatively, or in addition, the optical sensors may operate in different wavelength bands and the sensor measurements may be distinguished accordingly. A similar modification can be made to the embodiment of FIG. 5B to return the light along a separate upward-going path.

In many cases, a temperature and pressure profile of the well may be predictable enough that a distributed temperature/pressure sensing system is deemed unnecessary, and in such cases it may be omitted. Where such a system is deemed useful, the downhole optical sensor system 12 may further operate as a distributed temperature and/or pressure measurement system. Such systems are commercially available and may be modified to provide the chemical species sensing described above without sacrificing their ability to obtain distributed temperature and/or pressure measurements. Such systems may operate based on measurements of backscattered light from impurities along the length of the fiber. Such backscattered light has properties indicative of temperature and stress at the scattering location. The surface interface transmits light pulses and measures the properties of the backscattered light as a function of time. Combined with knowledge of the light's propagation velocity in the fiber, such measurements can be readily converted to position-dependent measurements of pressure and temperature. These measurements may be made on the optical fibers coupling the surface interface to the downhole optical sensors, or they can be made on separate optical fibers provided within cable 44. Where separate fibers are used, an additional light source and detector can be employed, or the existing source and detector may be switched periodically between the fibers.

The multi-measurement fiber optic cable may, for example, be deployed in a borehole along a fluid flow path (e.g., cable 44 in FIG. 4) such that the fiber optic cable experiences the same temperature and/or pressure as fluid flowing in the well. A surface interface (e.g., the surface interface 42 of FIG. 1) may transmit light pulses into the optical fibers and collect measurements for use by a measurement system.

Figure 6:
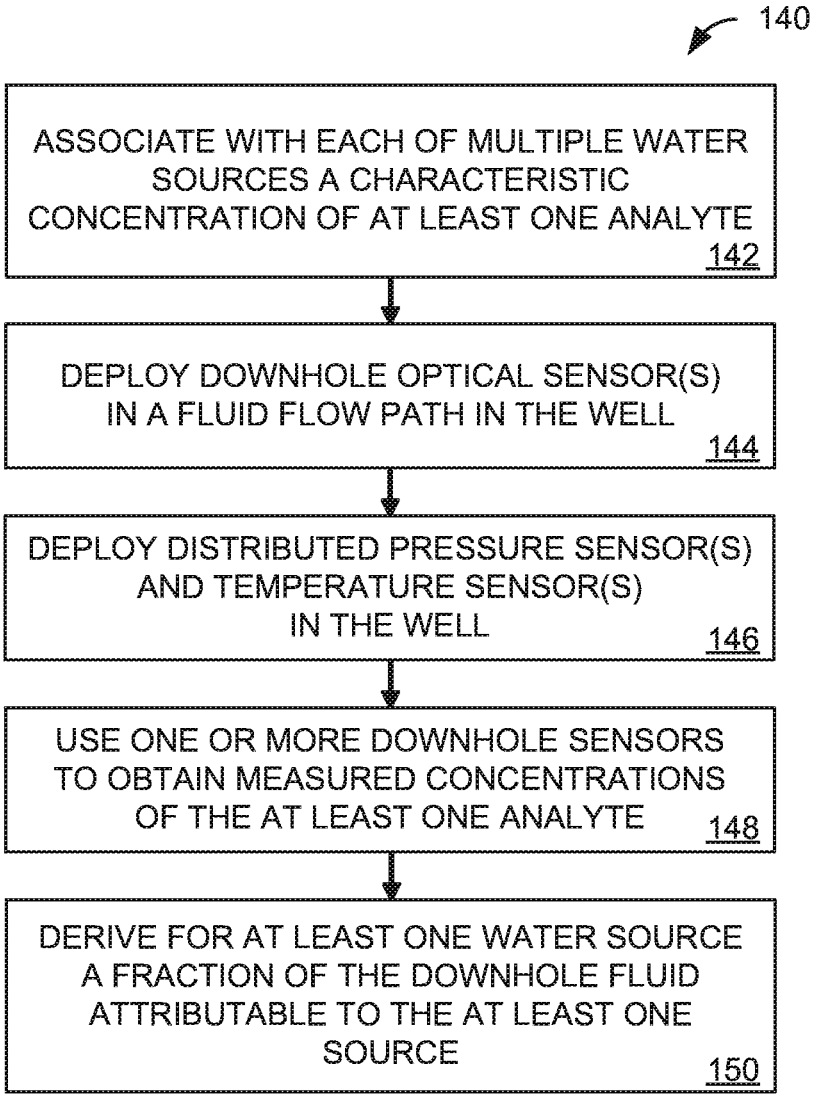
FIG. 6 is a flowchart of an illustrative method for determining sources of water in a downhole fluid.

FIG. 6 is a flowchart of a method 140 for determining sources of water in a downhole fluid (e.g., the produced fluid 28 of FIG. 1). During a first block 142 of the method 140, a characteristic concentration of at least one analyte is associated with each of multiple sources of water. For example, characteristic concentrations of multiple analytes may be associated with each of multiple sources of water during the block 142. One or more downhole optical sensors (e.g., the optical sensor 40 of FIG. 1 or FIGS. 3-4, or the optical sensors 120 of FIGS. 5A-5C) are deployed in a fluid flow path (e.g., the produced fluid 28 of FIG. 1) in the well during a block 144. Concurrently or separately, a distributed temperature sensor and/or a distributed pressure sensor may be deployed in the well during block 144 during a block 146. During a block 148, measured concentrations of the at least one analyte are obtained (e.g., via the downhole optical sensors). A fraction of the downhole fluid attributable to the at least one source is derived for at least one source of water during a block 150.

Numerous modifications, equivalents, and alternatives will become apparent to those skilled in the art once the above disclosure is fully appreciated. It is intended that the following claims be interpreted (where applicable) to embrace all such modifications, equivalents, and alternatives.

What is claimed is:

1. A system that comprises:

a pump that pumps fracturing fluid into a downhole formation via a borehole;

one or more optical downhole sensors along a fiber optic cable deployed in the borehole and attached along an exterior of a casing string or production tubing to measure at least one analyte concentration in a downhole fluid;

a processor; and a non-transitory computer-readable medium having instructions executable by the processor to cause the system to, identify analyte concentration characteristics for different types of water-based fluids including the fracturing fluid and at least one other type of water-based fluid, wherein the analyte concentration characteristics indicate differing concentration ranges of one or more chemical species for each of the different types of water-based fluids;

determine an amount of water in the downhole fluid corresponding to each of the different types of water-based fluids based, at least in part, on the analyte concentration characteristics and measurements of the at least one analyte concentration from the one or more-optical downhole sensors; and control the pump pumping fracturing fluid into the downhole formation via the borehole based, at least in part, on the amount of water corresponding to each of the different types of water-based fluids.

2. The system of claim 1, wherein the at least one analyte comprises ions.

3. The system of claim 1, wherein the different types of water-based fluids further include connate water.

4. The system of claim 1, wherein the different types of water-based fluids include a flood fluid from a remote well.

5. The system of claim 1, wherein each of the one or more optical downhole sensors includes:

a waveguide for conducting light; and a reagent region positioned between the waveguide and the downhole fluid to absorb a portion of the light from the waveguide, the portion being dependent upon a concentration of at least one analyte.

6. The system of claim 1, wherein the amount of water corresponding to each of the different types of water-based fluids is determined as a fraction of the downhole fluid.

7. The system of claim 1, wherein the amount of water corresponding to each of the different types of water-based fluids is determined as a difference or ratio between water amounts corresponding to the different types of water-based fluids.

8. The system of claim 1 further comprising instructions executable by the processor to cause the system to interpolate from the analyte concentration characteristics to determine the amount of water corresponding to each of the different types of water-based fluids.

9. The system of claim 1 further comprising instructions executable by the processor to cause the system to determines the amount of water corresponding to each of the different water-based fluids as a function of time.

10. The system of claim 1 further comprising instructions executable by the processor to cause the system to determine the amount of water corresponding to each of the different types of water-based fluids as a function of position in the borehole.

11. A method that comprises:

pumping, by a pump, fracturing fluid into a downhole formation via a borehole;

identifying analyte concentration characteristics for different types of water-based fluids including the fracturing fluid and at least one other type of water-based fluid, wherein the analyte concentration characteristics indicate differing concentration ranges of one or more chemical species for each of the different types of water-based fluids;

obtaining analyte concentration measurements from one or more optical downhole sensors along a fiber optic cable deployed in the borehole and attached along an exterior of a casing string or production tubing;

determining an amount of water corresponding to each of the different types of water-based fluids based, at least in part, on the analyte concentration characteristics and the obtained analyte concentration measurements; and pumping, by the pump, fracturing fluid into downhole formation via the borehole based, at least in part, on the amount of water corresponding to each of the different types of water-based fluids.

12. The method of claim 11, further comprising:

deploying at least one of a distributed pressure sensor and a distributed temperature sensor downhole, wherein said determining is based at least in part on measurements from the distributed pressure sensor or distributed temperature sensor.

13. A system that comprises:

a pump that pumps fracturing fluid into a downhole formation via a borehole;

at least one optical downhole sensor along a fiber optic cable deployed in the borehole and attached along an exterior of a casing string or production tubing to measure concentrations of multiple analytes in a produced fluid;

a flow sensor that measures a flow rate or an accumulated flow amount of the produced fluid; and a processor; and a non-transitory computer-readable medium having instructions executable by the processor to cause the system to, identify analyte concentration characteristics for different types of water-based fluids including the fracturing fluid and at least one other type of water-based fluid, wherein the analyte concentration characteristics indicate differing concentration ranges of one or more chemical species for each of the different types of water-based fluids;

determine an amount of water in the produced fluid corresponding to the different types of water-based fluids based on a comparison of the analyte concentration characteristics with analyte concentration measurements collected by the at least one optical downhole sensor;

determine a flow rate of the fracturing fluid as a function of time based, at least in part, on flow measurements of the produced fluid collected by the flow sensor and the amount of water corresponding to the different types of water-based fluids; and control the pump pumping fracturing fluid into the downhole formation via the borehole based, at least in part, on the amount of water corresponding to the different types of water-based fluids and the flow rate of the fracturing fluid.

14. The system of claim 13, further comprising multiple optical downhole sensors positioned at different locations in a well, wherein the amount of water corresponding to the different types of water-based fluids is determined as a function of time and position.

15. The system of claim 13, wherein the at least one optical downhole sensor measures concentration of at least one analyte comprising an ion.

16. The system of claim 15, wherein the ion is selected from the group consisting of: sodium, potassium, borate, calcium, magnesium, iron, barium, strontium, chloride, sulfate, and bicarbonate.

* * * * *